United States Patent [19]

Bezstarosti et al.

[11] 3,968,817

[45] July 13, 1976

[54] METHOD OF AND APPARATUS FOR CONTINUOUS PROGRESSIVE BEATING UP OF WEFT IN TRAVELLING-WAVE SHEDDING LOOMS

[75] Inventors: Ladislav Bezstarosti; Jaroslav Čižek; František Jekl; Lumír Martinek, all of Usti nad Orlici, Czechoslovakia

[73] Assignee: Vyzkumny Ustav Bavlnarsky, Usti nad Orlici, Czechoslovakia

[22] Filed: Apr. 26, 1971

[21] Appl. No.: 137,248

[30] Foreign Application Priority Data

Apr. 28, 1970 Czechoslovakia ..... 2939-70

[52] U.S. Cl. ..... 139/436; 139/191; 139/192

[51] Int. Cl.[2] ..... D03D 47/26; D03D 49/60; D03D 49/62

[58] Field of Search ..... 109/12, 188, 191, 192, 109/13

[56] References Cited

UNITED STATES PATENTS

| | | | |
|---|---|---|---|
| 717,905 | 1/1903 | Ott | 139/192 |
| 720,181 | 2/1903 | Salisbury | 139/12 |
| 872,035 | 11/1907 | Wattie | 139/191 |
| 955,211 | 4/1910 | Salisbury | 139/12 |
| 2,144,947 | 1/1939 | Valentine | 139/12 |
| 3,124,165 | 3/1964 | Slayter et al. | 139/12 |
| 3,263,705 | 8/1966 | Rossmann | 139/12 |
| 3,379,223 | 4/1968 | Fend | 139/12 |
| 3,477,475 | 11/1969 | Rossmann et al. | 139/12 |

FOREIGN PATENTS OR APPLICATIONS

| | | | |
|---|---|---|---|
| 496,147 | 11/1938 | United Kingdom | 139/191 |
| 23,906 | 1900 | United Kingdom | 139/192 |
| 185,769 | 10/1966 | U.S.S.R. | 139/12 |

*Primary Examiner*—James Kee Chi

[57] ABSTRACT

Method of and apparatus for continuous progressive beating up of weft in travelling-wave shedding looms with simultaneous picking of weft threads into the warp in which the weft in the shed is affected by a beating up force progressing in the weaving direction. The weft is first affected by a beating up force which is the resultant of a force acting in the direction of the weaving plane and another force acting in the direction towards the weaving plane, and then is affected by a beating up force acting in the direction of the weaving plane, while the beating up force continuously progresses in accordance with the travelling shed weaves along the whole warp width.

3 Claims, 16 Drawing Figures

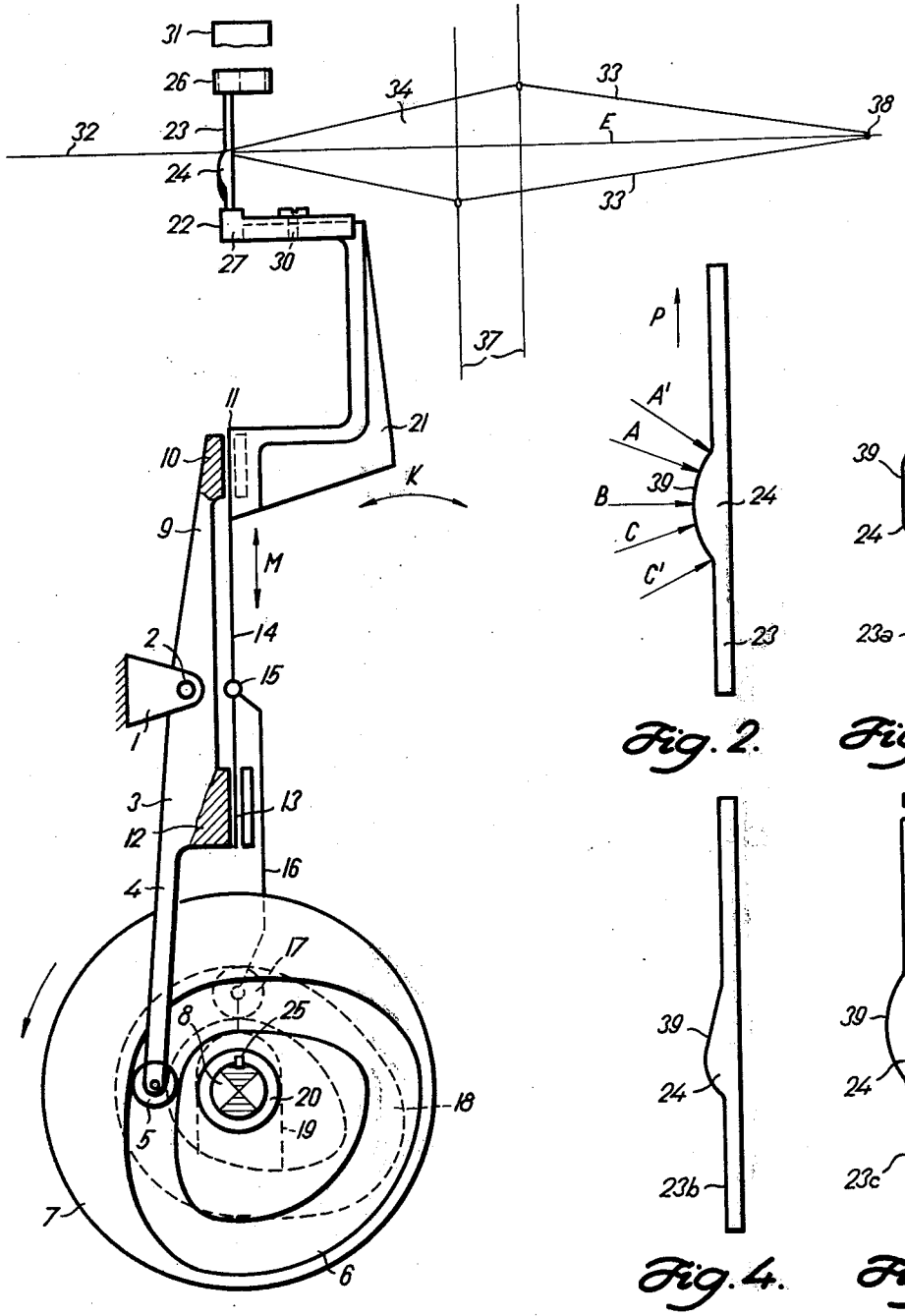
Fig. 1.
Fig. 2.
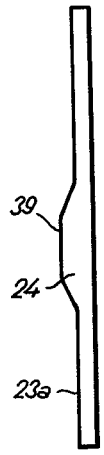
Fig. 3.
Fig. 4.
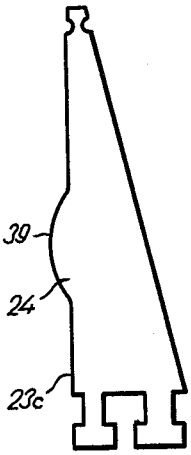
Fig. 5.
INVENTORS:
LADISLAV BEZSTAROSTI
JAROSLAV CIZEK
FRANTISEK JEKL
LUMIR MARTINEK
BY: Arthur O. Klein
ATTORNEY

INVENTORS:
LADISLAV BEZSTAROSTI
JAROSLAV CIZEK
FRANTISEK JEKL
LUMIR MARTINEK

BY: Arthur O. Klein
ATTORNEY

INVENTORS:
LADISLAV BEZSTAROSTI
JAROSLAV CIZEK
FRANTISEK JEKL
LUMIR MARTINEK

BY: Arthur O. Klein
ATTORNEY

INVENTORS:
LADISLAV BEZSTAROSTI
JAROSLAV CIZEK
FRANTISEK JEKL
LUMIR MARTINEK

BY: Arthur O. Klein
ATTORNEY

INVENTORS:
LADISLAV BEZSTAROSTI
JAROSLAV CIZEK
FRANTISEK JEKL
LUMIR MARTINEK

BY: Arthur O. Klein
ATTORNEY

METHOD OF AND APPARATUS FOR CONTINUOUS PROGRESSIVE BEATING UP OF WEFT IN TRAVELLING-WAVE SHEDDING LOOMS

The present invention relates to a method of and an apparatus for performing continuous progressive beating up of weft by means of a divided reed on weaving looms with simultaneous picking of weft threads into travelling-wave warp sheds.

During weaving on conventional looms, substantially these operations are performed: creating a warp shed, inserting a pick into the shed, beating up the weft, and changing the shed.

On one-shuttle weaving looms all of these operations are always performed simultaneously across the entire fabric width, i.e. after a shed has been formed extending over the whole width of the warp, a weft is picked into it and beaten up by one single movement of the reed from the rear position to the front position during the operation of changing the shed. The weaving process continues by repeating these operations. The beat-up force actuated by the movement of the reed from the rear position to the front position simultaneously affects the weft across the entire warp width in the direction of the weaving plane.

In known weaving looms with simultaneous picking of the weft threads into warp, i.e. in looms in which weft threads are inserted simultaneously by a plurality of shuttles following one another at equal spacings, the warp shed is created in a wave-like form, i.e. in travelling-wave sheds following one another in the weaving direction. The weaving direction is given by the direction in which the shuttles progress in the warp shed and is identical with it. In front of every shuttle the shed opens and its change takes place behind every shuttle. The length of the shed wave corresponds with the pitch of sheds travelling through the shed.

The beating up of picked weft is performed in wavy cycles as well. For this purpose the reed is divided into a number of sections swinging out from the rear position to the front position. The divided reed performs a wave-like movement and the beat-up waves progress in the weaving direction. Before every travelling shuttle the section of the divided reed returns to the rear position in order to allow the next shuttle to travel, and after every shuttle they swing into the front position in order to beat up the inserted picks, by sectors equalling the width of the section of the divided reed. The length of the beat-up wave corresponds to the length of the shed wave. The wave-like movement of the divided reed, as well as the travelling-wave shed, are synchronized with the progress of the weft in the shed. The beat-up force in weaving looms with simultaneous picking of weft threads into warp affecting the weft, consequently, progresses in the weaving direction by sectors that equal the width of the section of the divided reed. The beat-up force affects the weft in the direction of the weaving plane.

The disadvantage of this method of beating-up the weft consists in that the fabric carries traces of the individual sections of the divided reed, that is, it is characterized by structure changes of the fabric in the places where one beat-up sector ends and another begins.

The above disadvantages are substantially eliminated by the method of and apparatus for performing a continuous progressive beating up of weft on weaving looms with simultaneous picking of weft threads into the warp according to the present invention.

It is therefore an object of the present invention to provide a novel method in which the weft is first effected by a beating up force which is the resultant of a force acting in the direction of the weaving plane and another force acting in the direction towards the weaving plane, and then by a beating up force acting in the direction of the weaving plane, while the beating up force is progressing continuously in accordance with the travelling shed waves along the whole warp width.

In an apparatus in accordance with the invention for performing the method, the splits of every section there are formed beating up projections with beating up edges. With respect to the advanced beat-up edge of the split arranged at the side of the section and directed opposite to the direction of weaving the said projections with beating up edges are mutually equally shifted against the direction of the movement of sections in the beat-up operation. The sections of the reed are connected with the drive mechanism and accommodated, on the one hand, slidably in the direction of a straight line intersecting the weaving plane and, on the other hand, swingably in a plane intersecting the weaving plane and leading across the weaving direction.

On the splits, beating up projections are formed with beating up edges which are mutually regularly shifted in the direction of the longitudinal axes of the sections in such a way that the connecting lines of the homothetic or similarly placed points of beat-up edges of all splits of the sections form straight lines. Such straight lines in the front position of the sections at the beginning of the beat-up are inclined with respect to the weaving plane including with it an acute angle the arms of which open in the weaving direction, while the sections of the reed are connected with the drive mechanism and accommodated, on the one hand, slidably in the direction of their longitudinal axes intersecting the weaving plane and, on the other hand, swingably in a plane intersecting the weaving plane and leading across the weaving direction. In a preferred embodiment every section of the reed is connected with an adjacent joint mechanism of drive wherein the movement of the joint mechanisms is performed with sequential time lag in the weaving direction by the proportion of the time for one length of the beat-up wave and the number of sections of the reed in one beat-up wave.

In another preferred embodiment according to the present invention the joint mechanisms comprise the respective cams on a common shaft wherein said cams are angularly shifted with respect to one another by an angle equalling the proportion of the round angle (360°) and the length of the beat-up wave expressed by the number of sections. In a further preferred embodiment the joint mechanism comprises a box cam connected with the driving shaft, while a roller of a swingable arm meshes with a first lateral groove of said cam, whereas a roller of a rod joined to a slidable bar slidably accommodated on a swingable lever and connected with a carrier with which a section of the reed is connected engages with a second lateral groove.

The advantage of the method and apparatus according to the present invention resides in the fact that the effect of individual sections of the divided reed upon the beating up function disappears, and along with that also the unfavorable influence upon the regularity of tension of the woven weft is removed. By changing the shape of beat-up edges of splits, the beating up time, the beat force, and the course of beating up can be changed according to the requirements of weaving technology.

Further advantages and features of the present invention will be more fully understood in the following detailed description read with the accompanying drawings in which:

FIG. 1 is a front view of the joint drive mechanism of one section of the divided reed;

FIGS. 2, 3, 4, and 5 show various different embodiments of the reed splits in front view;

Figure 8:
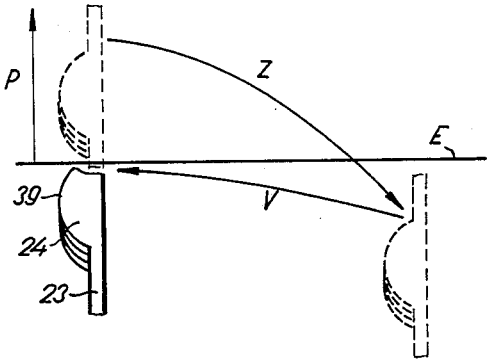
Figure 10:
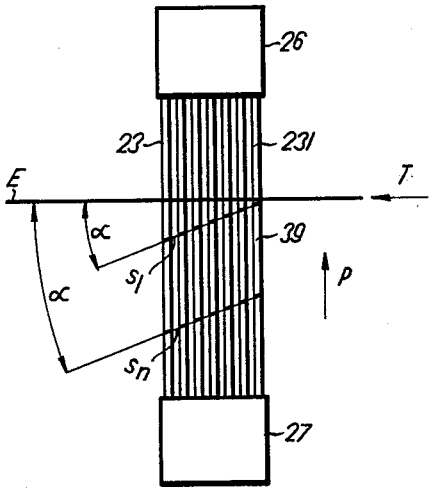
Figure 11:
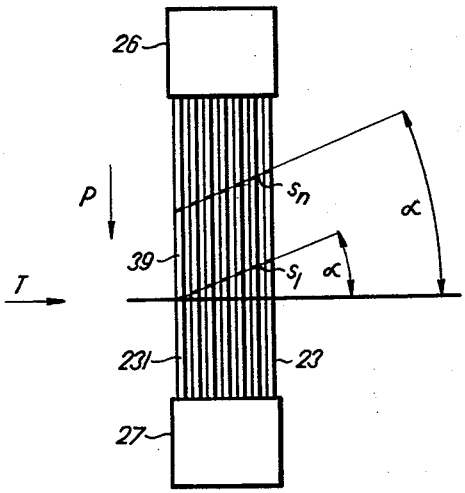
Figure 12:
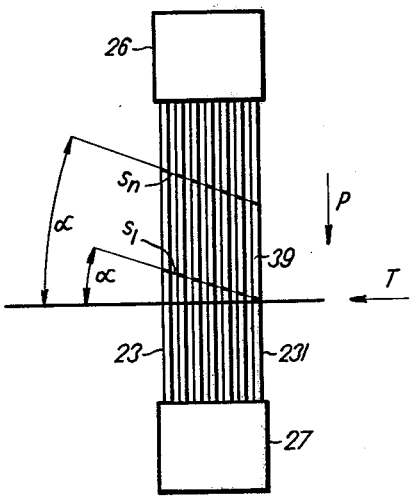
Figure 13:
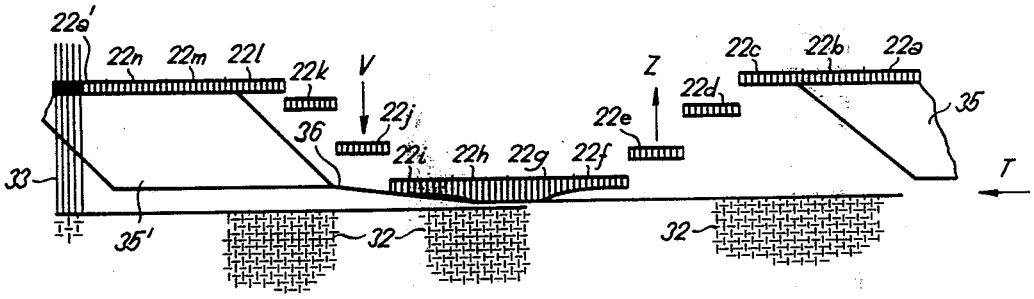
Figure 15:
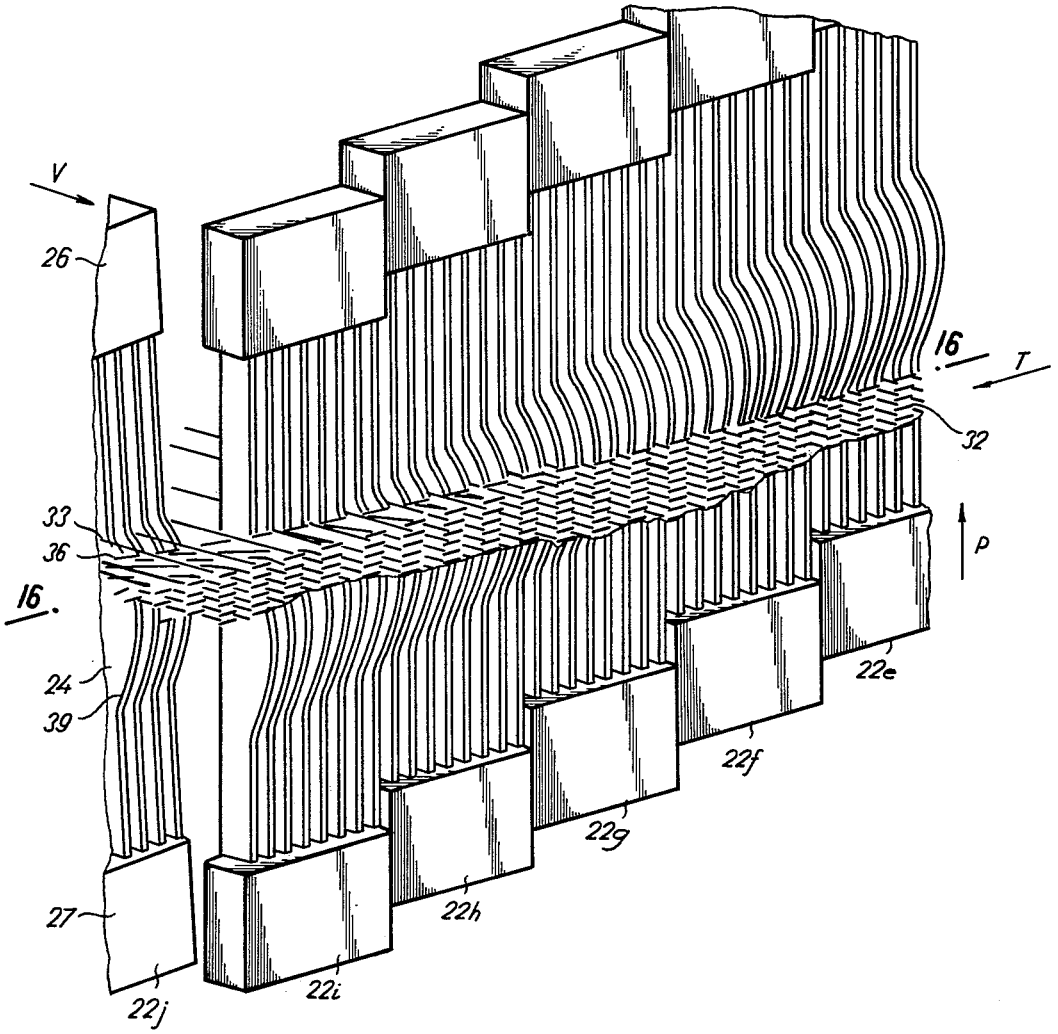
Figure 14:
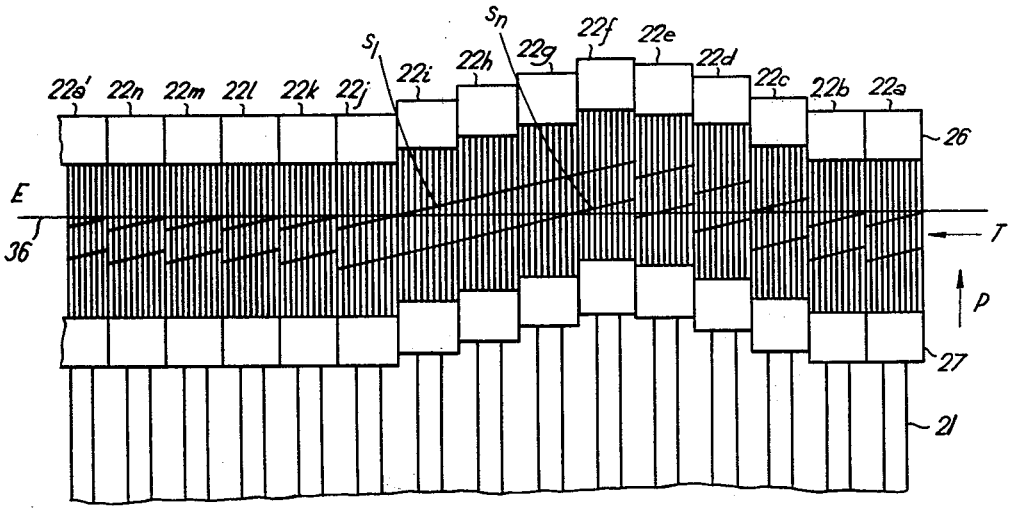

FIG. 8 schematically illustrates the course of the cyclic movement of one section of the divided reed;

FIGS. 9, 10, 11, and 12 diagrammatically illustrate various combinations of the weaving direction and the direction of the movement of the sections of a divided reed when beating up is performed, as viewed in the weaving plane of the fabric;

FIG. 13 is a diagram of the movement of individual sections of the divided reed and the travelling shuttles in plan view, i.e. as viewed perpendicularly to the weaving plane;

FIG. 14 is a front view of a part of a divided reed as viewed in the weaving plane of the fabric;

FIG. 15 is an axonometric view of a part of a divided reed; and

Figure 16:
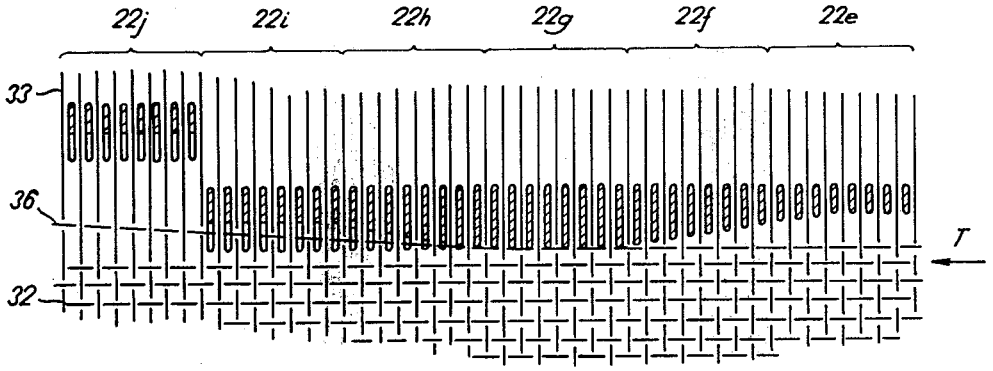

FIG. 16 is a section taken along the line 16—16 in FIG. 15 through a part of a divided reed in the weaving plane.

Turning now to FIG. 1, there is there shown a joint mechanism of the drive of a divided reed arranged under the warp consisting of a plurality of warp threads 33. On the fragmentarily shown frame 1 of the weaving loom a double-arm lever 3 is mounted in the vertical direction for swinging around the pin 2. At the end of the lower control arm 4 of the double-acting lever 3 a roller 5 is rotatably arranged, roller 5 meshing with a groove 6 at one side of a grooved or box cam 7. Cam 7 is fixed to a driving shaft 8 by means of a wedge or key 25. The driving shaft 8 is connected with a drive (not shown) of the weaving loom. At the end of the upper, controlled arm 9 of the double-arm lever 3, a projection 10 is formed comprising a guiding hole 11 extending in the vertical direction. Approximately in the middle of the control arm 4 a second projection 12 is formed comprising a guiding hole 13 extending in the vertical direction and being coaxial with said guiding hole 11. The guiding holes 11, 13 slidably accommodate a shiftable rod 14. In the central part of the shiftable rod 14 a joint 15 is mounted, swingably connecting the shiftable rod 14 with a draw bar 16. On the draw bar 16 a roller 17 is rotatably mounted, roller 17 meshing with a groove 18 at the other side of the grooved cam 7. The draw bar 16 is terminated by a fork 19 which is mounted on a collar 20 of the grooved cam 7.

Figure 6:
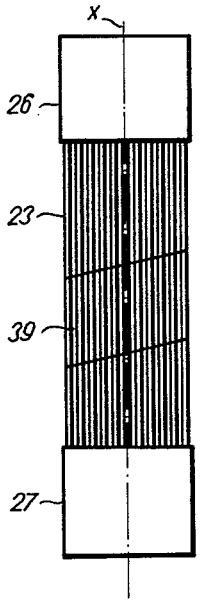
FIG. 6 is a front view of a section of the divided reed.
Figure 7:
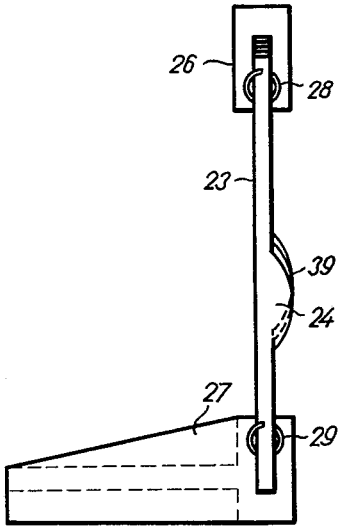
FIG. 7 is a side view of a section of the divided reed.
Figure 9:
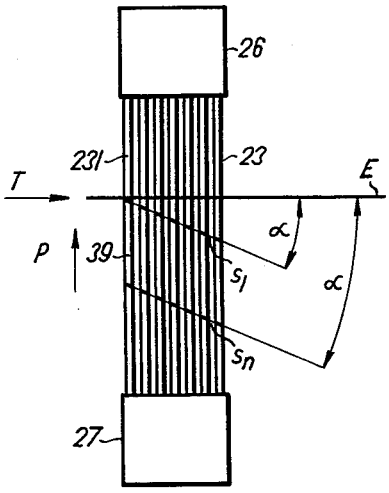

At the upper part of the shiftable rod 14, i.e. the part adjacent to the upper guide hole 11, the support 21 of the section 22 of the reed is fixed. The section 22 of the reed (FIGS. 6 and 7) comprises a row of splits 23 made of flat material, e.g. of steel laminae. In the central part of each split 23 a beat-up projection 24 with a beat-up edge 39 is formed in the plane of the split 23. A row of splits of the section 22 is fixed by one end in an upper holder 26 and by the other end in a lower holder 27, e.g. by means of soldering or by potting resin. A cylindrical helical spring 28 in the upper holder 26 and a cylindrical helical spring 29 in the lower holder act (FIG. 7) as spacer shims between the individual splits 23. The beat-up projections 24 are identical both as to shape and dimensions. The beat-up projections 24 of the section 22 of the reed are regularly shifted with respect to one another in the direction of the longitudinal axis *x* (FIG. 6) of the section 22, i.e. by the same distance. The lower holder 27 serves to mount the section 22 of the reed upon its support 21 by means of a screw 30. The upper holder 26 is seated in a guiding member 31 which prevents the adjacent sections 22 of the reed from undesirably striking against one another by limiting their side play.

From a warp beam (not shown) the warp threads 33 are fed over a lease 38 (FIG. 1), further over heddles 37 creating a shed 34, through the gaps between splits 23. The warp threads may travel at the sides of the section 22 to the front fell of the fabric 32 which is drawn off to a packing equipment (not shown) comprising, besides other elements, a rought beam and a cloth beam. The heddles are controlled by a control device (not shown). The beat-up projections 24 of the reed section 22 are turned to the front fell on the fabric 32. The weaving plane E leads through the center of the shed 34, the shed being limited, from center of the shed 34, the shed being limited, from the one side, by the lease 38, and from the other side by the fell of the fabric 32. The splits 23 of the section 22 intersect the weaving plane E in the shed 34 in the direction of the longitudinal axis *x* of the section 22. The shed 34 allows the shuttles 35 to pass through with the weft thread 36 as shown in FIG. 13.

FIGS. 2, 3, 4, and 5 show different shapes of the beat-up projections 24 of the splits 23. The shape of the beat-up projections and of their beat-up edges complies with weaving technology. In FIG. 2 the beat-up edge 39 is marked by means of three points A, B, and C. During the movement of the split 23 in the direction P in the process of beating-up, the beating-up of weft 36 begins at point A. The maximum beat-up is set at point B. The end of beat-up is at point C. It is possible, however, to adjust the beginning of the beat-up of weft 36 to the point A′ and its end at point B′, i.e. at points where the beat-up projection 24 projects in the plane of the split 23. In such case the length of the beat-up edge 39 marked by the points A′, B′, C′ equals the length of the beat-up projection 24.

The split 23*a* according to FIG. 3 is determined for a longer time of the maximum beat-up of the weft 36 by the shape of its beat-up projection 24. When splits 23*b* according to FIG. 4 are used, a slower increase of beat-up force sets in until its maximum is reached. The split 23*c* according to FIG. 5 has been adapted for double clamping in the lower holder 27 of the splits with the aim of obtaining a more rigid design of the divided reed. The splits can have various other shapes either with respect to the weaving technology or with the technology of the production of parts of the reed 22, and possibly also in accordance with the shape of shuttles 35 and their drive.

The number of joint mechanisms of the drive of the sections of the reed corresponds with the number of its sections 22. The number of sections 22 of the reed depends upon the width of the weaving area of the loom, and possibly also upon the number of beat-up waves falling to within the width of the warp, i.e. the fabric 32. The length of the beat-up wave, as well as the length of the shed wave, equal the spacing of the shuttles 35 travelling one after another through the shed 34. The travelling-wave sheds, the beat-up waves, as well as the shuttles 35 in the shed 34, always progress in the same direction, i.e. in the weaving direction T (FIGS. 9–12, inclusive) and the movement of all of them is synchronized by a device (not shown).

The number of sections 22 of a reed in one beat-up wave is chosen with respect to the shape of the projections 24 of the splits 23 and their beat-up edges 39, and with respect to the size of the phase shift of the beat-up projections 24 and their beat-up edges 39 in the direction of the length axis $x$ of the section 22; alternatively the number of sections 22 is chosen with respect to the value of inclination of the connecting lines $s_1$, $s_n$ of the homothetic points of the beat-up edges 39 of the beat-up projections 24 of all splits 23 of one section 22 (FIG. 14). In order to comply with the principle of coupling the beat-up function of all sections 22 of one reed, the beating-up is performed simultaneously by at least two adjacent sections 22 of the reed (FIG. 14). The angle of inclination of the connecting line $s_1$, $s_n$ is chosen with respect to the number of sections 22 in one beat-up wave and with respect to the length of the beat-up wave. The angle of inclination of the connecting lines $s_1$, $s_n$ is the same for all sections 22 of the reed.

FIGS. 9, 10, 11, and 12 show diagrammatically the dependence of the direction of the inclination of the connecting lines $s_1$, $s_n$ of homothetic points of the beat-up edges 39 from the weaving direction T and from the direction P of the movement of the sections 22 during the beating-up, as viewed from the fabric 32 in the weaving area E. The sections 22 are depicted in the front position at the beginning of beating-up, i.e. in the position wherein the first split 231 (FIG. 11) of the section 22 advanced with respect to all other splits 23 in the direction P of the movement of the section 22 is the first one to perform the beating-up of the weft 36 at the point A or A′ of the beating-up edge 39. The other split area, with respect to the advanced split 231, is mutually regularly phase shifted by the same distance against the direction P of the movement of the section 22 during the beating-up. There are innumerable connecting lines of homothetic points of the beat-up edges 39. They are marked as connecting lines $s_1$ to $s_n$. All connecting lines $s_1$ to $s_n$ are parallel straight lines including, with the weaving plane, an acute angle $\alpha$ the arms of which open in the weaving direction T. The same is true for all sections 22 of the reed. The direction of all inclination of the connecting lines $s_1$ to $s_n$ for all sections 22 of the reed is the same. It follows further from the said diagrams that the first advanced split 231 and its beat-up projection 24 with the beat-up edge 39 of the section 22 of the reed is at the side of the section 22, this side being directed against the weaving direction T. The same applies for all sections 22 of the reed.

The movement of sections 22 of the reed is performed with mutual time lag in the weaving direction T in proportion to the time necessary for one length of a beat-up wave and the number of sections 22 in one length of the beat-up wave. In an embodiment of a joint mechanism according to FIG. 1, this is obtained by turning the grooved cams 7 by the angle $\beta$ expressed in degrees, with respect to one another, according to the formula $$\beta = 4\ R/\lambda$$

wherein $4R$ is a round angle, i.e. 360°

$\lambda$ = the length of the beat-up wave expressed by the number of sections 22.

If, e.g. one beat-up wave consists of 12 sections 22 of the reed, the grooved cams 7 on the common shaft 8 will be turned with respect to one another by the angle $\beta = 360°/12 = 30°$, to produce the required time lag in the weaving direction T. In the following beat-up wave the relative turning of the cams is carried out in the same way. This is repeated as many times as there are beat-up waves across the entire weaving width of the loom, in other words, the width of the fabric 32.

In an alternative embodiment (not shown), the joint mechanism uses two independently working cams or cams with counter pressure springs. In another alternative embodiment (also not shown) for the control of the support of the section of the reed in the direction V and Z (FIG. 8) a shaped cam is used with an outer and an inner roller accommodated on the support. The vertical beat-up movement is performed by means of a circumferential shaped cam with one inner and one outer roller which is placed at the opposite side of the cam creating the movement of the support. The rollers of the cam actuating the vertical beat-up movement P are arranged on a double-arm lever swingably accommodated on a pin, the other arm of which carries a joint connected support of the section of the reed. In still another alternative embodiment (also not shown), a multi-joint crank mechanism is used in the joint mechanism. The joint mechanism can be arranged over the shed as well as under it, and its position can also be horizontal.

As will be obvious from FIG. 1, the section 22 of the reed is arranged on the joint mechanism and is supported slidably in the direction of a straight line (not shown) which is the length axis $x$ of the section 22 intersecting the weaving plane E and leading across the weaving direction T. Thus the cyclic movement of the section 22 is possible, as shown diagrammatically in FIG. 8. If the front position of the section 22, at the beginning of the beating-up or slightly ahead of that, is considered as the starting point, then the movement towards starting the beating-up is performed first, then in the direction P, wherewith the beat-up edges 39 pass across the weaving plane E, perform the beating-up and continue to the end of the beating-up or slightly behind that. Then the section 22 moves along a curve in the direction Z to the rear position, wherefrom it again returns along a curve in the direction V to the position at the beginning of the beating-up or slightly ahead of it. The same movement is carried out by all sections 22, however, with a time lag as has been described hereinbefore.

The beat-up movement P of a part of the reed 22 need not be performed along a straight line; in some embodiments it can follow a circular path or have another course, provided the projections 24 of the splits 23 in the part of the reed 22 have been adapted for such movement so as to create a straight selvedge.

The process of smooth continuous beating-up of weft, as well as the operation of an apparatus for performing the same, will be further explained with respect to the above description and the drawings referred to, as well as further drawings on FIGS. 13, 14, 15, and 16.

First, the drive of the weaving loom is switched on. Accordingly, the control mechanism of the heddles 37 creating the wave-like shed 34 is actuated; further, the device for shifting the shuttles 35 of the weft 36 and the drive of the joint mechanism driving the divided reed are actuated. The grooved cam 7 rotates in the direction of the curved arrow (FIG. 1). The roller 5 follows the course of the groove 6, swinging the double-arm lever 3 out into swingable movement in the direction shown by the double arrow K. The second roller 17 follows the shape of the second groove 18 and sets the shiftable rod 14 into sliding movement in the direction shown by the double arrow M. By compounding these two movements the controlled arm 9 of the double-arm lever 3 creates a cyclic movement of the section 22 fixed on the support 21. This cyclic movement has already been described in connection with FIG. 8. All other sections 22 are brought into the same cyclic movement, however, with a time lag. Starting from the position of the section 22, as has been illustrated in FIG. 1, wherein the section 22 is in the front position at the beginning of the beating-up, and in consequence of the passage of the shuttle 35 the weft 36 has been inserted into the shed 34; the section 22 starts moving in the direction P. The beat-up edge of the first advanced split 231 starts pushing the weft 36 at the point A or A' and said weft slips over the inclined part of the beat-up edge 39 to the front fell of the fabric 32. During its movement the beat-up edge 39 reaches the position wherein the weaving plane E intersects the point B on the beat-up edge 39. The maximum beating-up of weft 36 takes place here, while the fell of the fabric 32 is slightly shifted and the warp is tensioned in the direction of the weaving plane E.

During the further movement of the section 22, the pressure upon the fell of the fabric 32 is gradually loosened, i.e. the beating-up force decreases, until the fell of the fabric 32 leaves the beat-up edge 39 in point C or C'. Before the fell of the fabric 32 frees itself from the beat-up edge 39 in point C', i.e. still at the time when beating-up takes place, the following part of the weft 36 in the area between the next two adjacent warp threads 33 sets in by means of the beat-up edge 39 of the next split 23. Every following split 23 is always shifted opposite the direction P of the section 22 in the beating-up with respect to the first advanced split 231.

The course of the beating-up of the weft 36 by means of the beat-up edge 39 of that adjacent split 23 is the same; the way in which the beat-up edges 39 of the following splits 23 take up their movement is also identical. At the moment when the beat-up edge 39 of the last split 23 of the section 22 performs the beating, the following section 22 is prepared at its side in the weaving direction P, in order to go on continuously, following the beating-up of the preceding section 22 by its movement in the direction P, i.e. its first advanced split 231 will start performing the beating-up of weft 36 to the fell of the fabric 32 in the same way by its beat-up edge 39, which takes place in the area between two adjacent warp threads 33 which correspond with that split 231. This mutual interlinking of beating-up goes on in every beat-up wave and between the waves. By means of the shape of the beat-up edges 39, as well as by adjusting their shift with respect to one another the state can be obtained under which a number of sections 22 perform beating-up simultaneously (FIGS. 13, 14), as if these sections were an integral part of one broad section of a reed.

As early as during the beating-up the change of shed sets in. As soon as the section has terminated the beating-up of the weft 36 by all its splits 23, it changes its movement in the direction P in a movement along the curve in the direction Z to the rear position, while moving downwards, in order to give free passage to the next shuttle 35 with the weft 36. After the following shuttle 35 has passed, the section 22 returns to the position which is assumed at the beginning of the beating-up along a curve in the direction V. This process repeats itself in individual beat-up waves across the entire width of the warp. During the movement of the beat-up edge 39 in the direction P in the beating-up, the weft 36 pushed to the fell of the fabric 32 over the inclined part of the beat-up edge 39, in the sector determined by point A or A' and point B is affected by the beat-up force which is the resultant of two forces, i.e. the force acting in the direction of the weaving plane E and the force acting in the direction acting towards the weaving direction E. At point B one beat-up force is acting, i.e. in the direction of the weaving plane E. The beating-up is performed smoothly and continuously in accordance with the travelling waves across the entire warp width.

In the embodiment of the invention shown in FIGS. 13 and 14, the sections **22*a*, 22*b*, 22*c* are at the rear position in order to allow the shuttle 35 to pass through the shed 34 in the weaving direction T. The sections 22*d* and 22*e* return to the rear position in the direction Z when the beating-up is terminated. Whereas the sections 22*f* are then terminating the beating-up, the sections 22*g*, 22*h*, and 22*i* are then performing it. On the other hand, the sections 22*j* and 22*k* are returning back in the direction V to the front position to the beginning of the beating-up as soon as the previous shuttle 35' has passed. The following sections 22*l*, 22*m*, 22*n*, 22*a'*, 22*b'*, and 22*c'* are also in the rear position in order to allow the passage of the shuttle 35' with the weft 36. The section 22*d'* is returning to the rear position in the direction Z. The beating-up is performed, in this case, by sections 22*f*, 22*g*, 22*h*, 22*i*. The identical connecting lines $s_1$ to $s_n$ of the congruent points of the beat-up edges 39 of these four sections 22*f*, 22*g*, 22*h*, and 22*i*** integrate in one straight line.

The course of the smooth continuous beat-up of weft 36 can be seen in a very illustrative way in the detailed FIGS. 15 and 16. The section **22*e* has finished its movement in the direction P, and the beat-up edges 39 of the beat-up projections 24 of their splits 23 have already left the fell of the fabric 32. The section 22*e* moves into the rear position while moving downwards (FIG. 3). The section 22*f* has gradually passed over the fell of the fabric 32 by the beat-up edges 39 of the splits 23 and leaves it. The section 22*g* is in the phase of the maximum beat-up of weft 36 to the fell of the fabric 32. In this phase also, the change of the shed 34 of the warp threads 33 takes place. The section 22*h* has already performed a part of its movement in the direction P and the beat-up edges 39 enter gradually into contact with the weft 36 in shifting it through the still open shed 34 to the fell of the fabric 32. The section 22*i* is in its front position at the beginning of the beating-up and, consequently, does not yet perform the beating-up, since the beat-up edges 39 of its splits 23 are under the fell of the fabric 32. The section 22*j* is in the phase in which it moves to the front position at the beginning of the beating-up in the direction V, as soon as the shuttle 35 passes with the weft 36, i.e. it is getting near the front position of the beginning of the beat-up, i.e. next to the fell of the fabric 32.**

Although the invention is illustrated and described with reference to a plurality of preferred embodiments thereof, it is to be expressly understood that it is in no way limited to the disclosure of such a preferred embodiment, but is capable of numerous modifications within the scope of the appended claims.

What is claimed is:

1. In a travelling-wave shedding loom provided with means for the simultaneous picking of weft into the warp and affecting the weft in the shed by a beating-up force progressing in the weaving direction, and apparatus for the beating-up of the weft comprising a reed divided into sections, the sections consisting of spaced splits, the gaps between the splits serving for the passage of the warp threads, beating-up projections formed on the splits, the beating-up projections of each section being mutually shifted in such a way that the connecting lines of their homothetic points form straight lines, said straight lines being inclined with respect to the weaving plane and forming with it an acute angle the arms of which open in the weaving direction, and a mechanism forth driving the sections back and forth and with an upward and downward wave-like motion.

2. Apparatus according to claim 1, wherein the drive mechanism for each section comprises a cam connected with a driving shaft, such cam having a first lateral groove and second lateral groove, a first roller meshing with the first lateral groove, a second roller meshing with the second lateral groove, a swingable lever to which the first roller is joined, a slidable bar slidably mounted on a swingable lever and to which the section is connected and a rod joined to the slidable bar and to which the second roller is joined.

3. A method of continuous progressive beating-up of weft in a travelling-wave shedding loom with simultaneous picking of weft into the warp in which the weft in the shed is affected by a beating-up force progressing in the weaving direction, comprising first affecting the weft by a beating-up force which is the resultant of a force acting in the direction of the weaving plane and another force acting in the direction towards the weaving plane, and then affecting the warp by a beating-up force acting in the direction of the weaving plane, and moving the beating-up force continuously in accordance with the travelling shed waves along the whole warp width.

* * * * *